US006752555B2

(12) United States Patent
Geddes et al.

(10) Patent No.: US 6,752,555 B2
(45) Date of Patent: Jun. 22, 2004

(54) ATTACHMENT PROVIDING COMFORTABLE GRIP

(76) Inventors: William T. Geddes, 11107 Powes Ave., Cockeysville, MD (US) 21237; Jennifer Weaver, 3518 Millvale Rd., Baltimore, MD (US) 21244

( * ) Notice: Subject to any disclaimer, the term of this patent is extended or adjusted under 35 U.S.C. 154(b) by 0 days.

(21) Appl. No.: 10/170,777

(22) Filed: Jun. 14, 2002

(65) Prior Publication Data

US 2003/0231917 A1 Dec. 18, 2003

(51) Int. Cl.[7] ..... A64B 5/02
(52) U.S. Cl. ..... 401/6; 16/430; D19/47
(58) Field of Search ..... 44/6, 195, 48, 44/131; D19/47, 48, 41; 16/430

(56) References Cited

U.S. PATENT DOCUMENTS

| | | | | | |
|---|---|---|---|---|---|
| 3,043,295 | A | * | 7/1962 | Ward | 601/139 |
| 3,905,113 | A | * | 9/1975 | Jacob | 32/40 R |
| 4,689,020 | A | * | 8/1987 | Rusk | 401/6 |
| D395,674 | S | * | 6/1998 | Boix Gacia | D19/51 |
| 5,926,901 | A | * | 7/1999 | Tseng et al. | 15/167.1 |
| 6,200,046 | B1 | * | 3/2001 | Rylander | 401/52 |
| 6,390,704 | B1 | * | 5/2002 | Baudino et al. | 401/6 |

* cited by examiner

*Primary Examiner*—David J. Walczak
(74) *Attorney, Agent, or Firm*—Mishrilal Jain

(57) ABSTRACT

A comfortable grip attachment to an article. Preferred is a bristle grip in various shapes and sizes. A method of producing the grip is also described.

12 Claims, 5 Drawing Sheets

End of Grip
(Enlarged Version)

Retractable Pen Diagram

ATTACHMENT PROVIDING COMFORTABLE GRIP

FIELD OF THE INVENTION

The present invention is related to a device that provides comfortable grip to an article to which said device is attached. More particularly, the present invention is related to a transferable or a permanently affixable attachment having a texture such that the texture provides a comfortable grip without causing cramping or fatigue to the hand of the person using said attachment, and a method of making said attachment.

BACKGROUND OF THE INVENTION

Currently pencils and other writing instruments have a small diameter forcing the user to tightly hold the writing instrument. The necessity to grasp a writing instrument with such a small diameter contributes to stress within the user's hand and leads to cramping and other strains, particularly after a prolonged use. The gripping device of the present invention offers a novel design and approach to alleviating this problem that the available grips, which are generally made of stiff or solid material, do not offer. Accordingly, there is a need for providing an attachment to an article that permits the user to grasp the article more loosely and comfortably so as to lessen the likelihood of cramping and other discomfort to the user. It is an additional need to effectively expand the diameter of the writing instrument to more naturally fit the contour of the user's hand so as to provide easy grasp without causing discomfort or stress to the hand.

SUMMARY OF THE INVENTION

Accordingly, it is an advantage of the present invention to meet these and other needs through preparing a device that provides comfortable grip to an article to which said device is attached. The device may be removable, transferable or permanently fixed to an article.

It is another object of the invention to provide a textured grip which fits on a pencil, pen or other writing instrument.

It is still another object of the invention to provide a grip for a writing instrument that is pleasant and comfortable to hold and that conforms to an individual user's hand or fingers while writing and provides for an expanded area with which to operate the writing instrument.

Another advantage of the device of the present invention is that it obviates cramping, strain or discomfort to a user, which would otherwise occur after a prolonged usage of the writing instrument without the benefit of the device of the present invention.

It is yet another object of the invention to provide a bristled grip which is simple in construction, low in cost and easy to manufacture.

To achieve the stated and other advantages of the present invention, as embodied and described below, the invention includes a device attachable to an article, comprising a means for providing a grip on an article without causing discomfort to the hand or fingers of a user, particularly on prolonged usage.

Additional advantages and novel features of the invention will be set forth in part in the description that follows, and in part will become more apparent to those skilled in the art upon examination of the following description of the drawings or upon learning by practice of the invention.

BRIEF DESCRIPTION OF THE DRAWINGS

References will now be made in detail to embodiments of the present invention, examples of which are illustrated in the accompanying drawings.

FIG. 5 illustrates how the invention can be permanently affixed to a writing instrument, such as a mechanical pencil, pen and the like.

DETAILED DESCRIPTION OF THE INVENTION

The invention includes a device attachable to an article so as to provide a textured grip on the article without causing stress, cramping, strain, fatigue or discomfort to the user, particularly upon prolonged usage, and a method for making the device.

It should be understood that unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the methods and materials described herein are preferred. Unless mentioned otherwise, the techniques employed or contemplated herein are standard methodologies well known to one of ordinary skill in the art. The materials, methods and examples are only exemplary and not limiting.

The term "texture" or "textured" as used herein means any protrusion of greater than 0.5 mm from the tubular body of the invention in linear, uniform or random alignment along the tubular member. Such protrusion may be rigid or soft and may protrude more or less at right angle from the tubular body of the invention. By its nature the invention will maintain a soft bristle texture with varying degrees of rigidity. The protrusions collectively expand the diameter of the invention uniformly or randomly by the length of the protrusion and thus provides for the ability to structure the invention in a particular contour or shape as desired.

Figure 1:
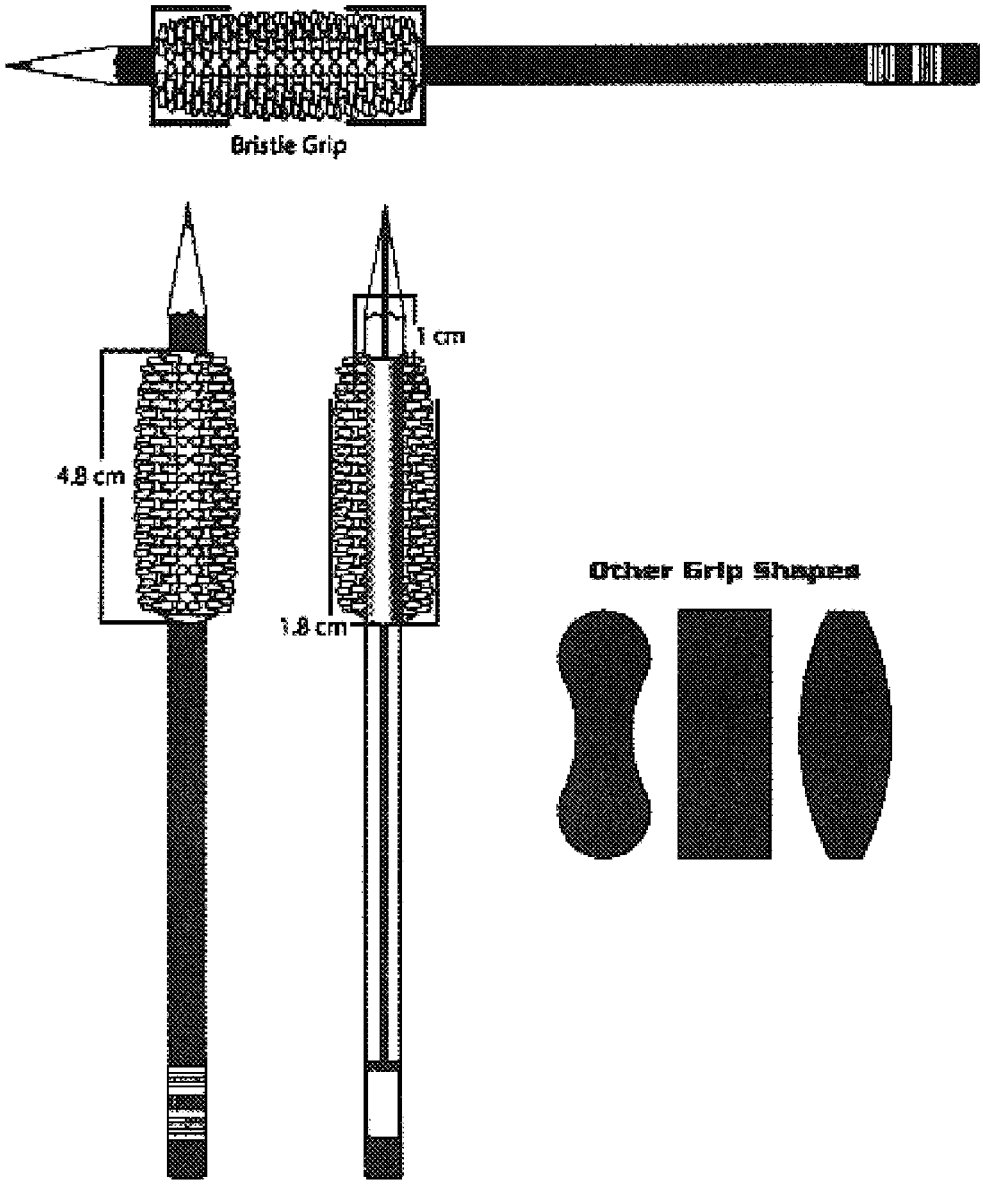
FIG. 1 exemplifies possible shapes the grip could take and the placement of the grip on a writing instrument with approximate dimensions of the grip.

FIG. 1 illustrates the placement of the grip on a writing instrument as well as the approximate dimensions of the grip. The dimensions will vary somewhat with the length of the bristles. FIG. 1 also depicts other possible shapes the grip could take. These shapes include an hourglass shape, a cylindrical shape and a barrel shape with a more extreme convex contour as typically illustrated in the drawing.

Figure 2:
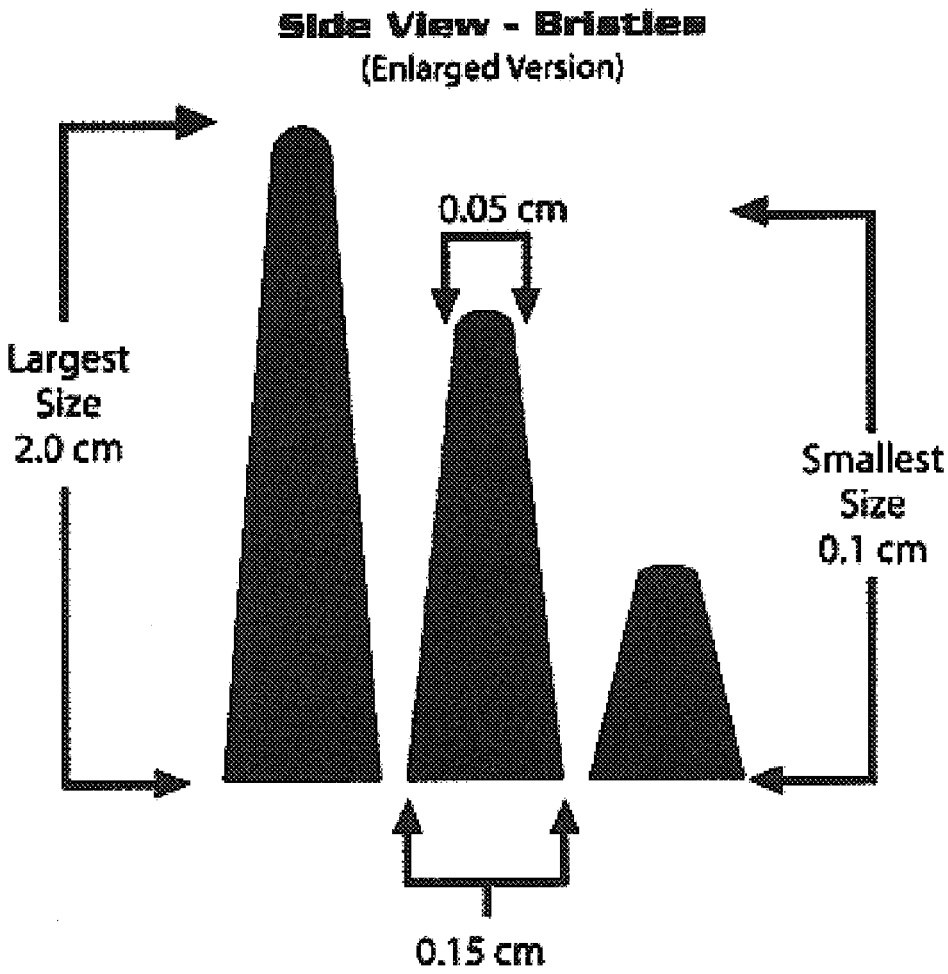
FIG. 2 shows the shape and approximate lengths of the bristles which emanate from the central tube of the grip.

FIG. 2 shows the shape and approximate lengths of the bristles which emanate from the central tube of the grip. The bristles will range from about 0.1 cm in length which would create more of a nubby effect, to about 2.0 cm to create more of a bristle effect.

Figure 3:
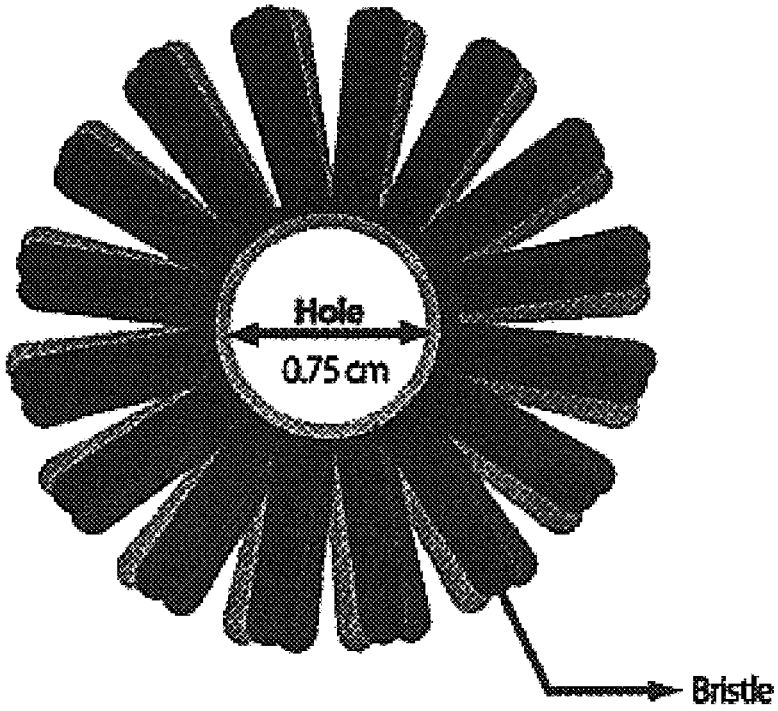
FIG. 3 depicts a cross sectional view and approximate diameter of the grip together with the front view of the hollow grip.

FIG. 3 depicts a cross sectional view of the grip and approximate diameter of the grip including the front view of the hollow grip.

Figure 4:
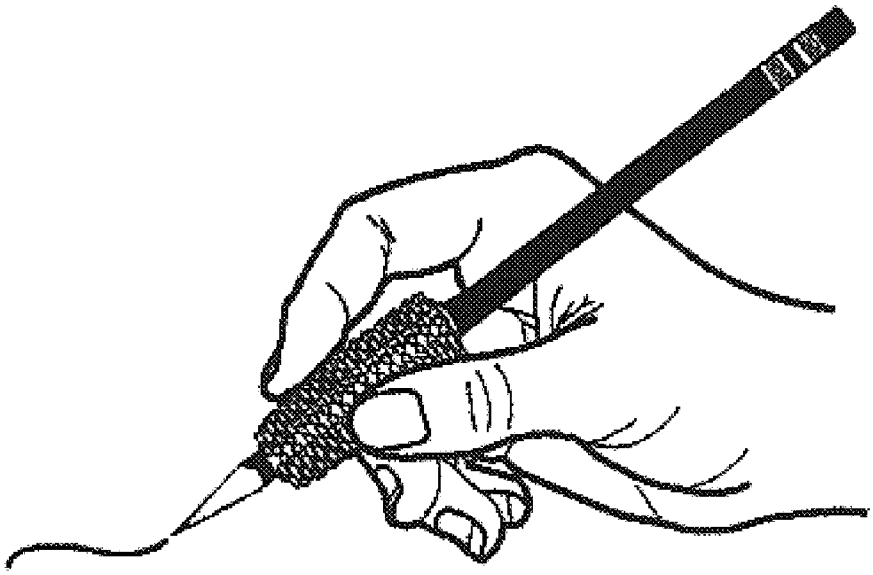
FIG. 4 demonstrates how the grip may be handled and placed on a writing instrument by the user.

FIG. 4 demonstrates the method by which the grip would be handled by a user and placed on a writing instrument. The drawing exemplifies the placement of the invention on a standard pencil.

Figure 5:
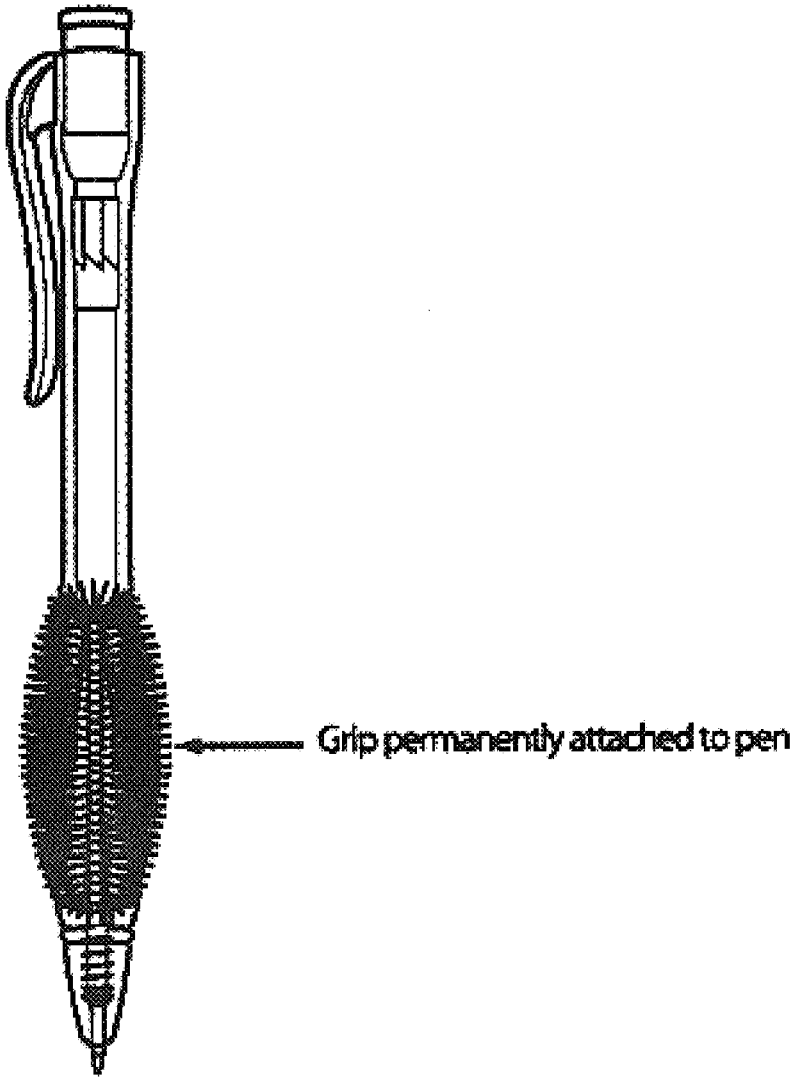

FIG. 5 illustrates how the invention can be permanently affixed to a writing instrument such as a mechanical pencil, pen and the like. In this instance a cavity is created in the writing instrument during the writing instrument production, into which the invention is inserted. The cavity could be manufactured at the depth necessary to make the tube from which the bristles emanate flush with the barrel of the writing instrument.

In a preferred embodiment of the invention, the device comprises a tubular product which acts as a sleeve over an article including a writing instrument in the area where the article is to be gripped. The device may be transferred from article to article or affixed to the article either temporarily or permanently.

In another embodiment of the invention, the article comprises a barrel shaped grip made of a soft plastic. Bristles emanate from the center sleeve in a uniform or varied manner and extend in all directions from the center sleeve. The grip may also be cylindrical, or hourglass in shape with bristles emanating from the sleeve in all directions. The bristles are pliable, adaptable and/or collapsible with the touch or hold of the user. It is this pliability, adaptability and/or collapsibility that permits the grip to conform to the contour of user's individual style of handling the writing instrument or the article to which the grip is attached. The texture of the bristle is typically smooth, soft, soothing and comfortable to the touch.

The grip can be formulated into a variety of styles, shapes, sizes and design. The bristle length can be varied from very short stubs to longer bristles. The sleeve can be varied with attachments to form different figures and shapes. The grip can be colored in solid colors, glitter colors, translucent material, or multi-colored and the like as desired.

The grip can also be manufactured as an individual unit which permits it to be transferred from one writing instrument to another. The grip may also be permanently affixed to writing instruments during the manufacturing process.

It may be noted that this invention can be utilized on items other than writing instruments such as "stick" type erasers, pencil sharpeners, stampers and the like.

A method of making a device attachable to an article, comprises the following essential steps:

(a) creating a mold which contains cavities in the inverse pattern of the bristles into which a liquid or semi-liquid material is forcefully injected;

(b) allowing for the liquid or semi-liquid material to cool down and harden;

(c) removing the hardened item from the mold;

(d) verifying that the liquid material completely filled the voids in the mold, and that each bristle is fully formed;

(e) spray painting the hardened product with the desired color or design; and then (f) drying the painted product through an air circulation process.

Of course, having learnt the teachings of the present invention, one skilled in the art may vary the manufacturing process in different ways to meet the objectives of the present invention.

Example embodiments of the present invention have now been described in accordance with the above advantages. It will be appreciated that these examples are merely illustrative of the invention and not limitations thereof. Many variations and modifications will be apparent to those skilled in the art and all such modifications and variations are included within the purview and scope of the appended claims.

What is claimed is:

1. A device, comprising a tubular product open at opposite ends thereof and attachable as a sleeve over a writing end of a writing instrument without prohibiting writing with the instrument, said product further enabling a grip for a users hand or fingers on the writing instrument while writing with said instrument, wherein said device comprises vertically oriented collapsible bristles that controllably collapse in direct response to a user's grip or grasp of said device without causing discomfort to the hand or fingers of the user when using said device, while said device remains attached to the article.

2. The device of claim 1, wherein said bristles are of soft plastics and range from about 0.1 cm to about 2.0 cm.

3. The device of claim 2, wherein said means is transferable, detachable or permanently affixed to an article.

4. The device of claim 3, wherein said means conforms to the touch of a user by the controlled collapse of the soft bristles around an area grasped by the user.

5. The device of claim 4, wherein the bristles are colorful or glittering.

6. The device of claim 5, attachable to a writing instrument, hand tool, or art instrument.

7. The device of claim 5, being of various shapes, sizes, color or design.

8. The device of claim 7, temporarily or permanently attached to a writing instrument.

9. The device of claim 1, wherein the outline of the vertically oriented bristles of said means creates a cylindrical or barrel shape of different sizes.

10. The device of claim 1, forming a tubular product, temporarily or permanently attachable to an article.

11. A device, comprising means for providing a grip for the hand or fingers of a user while writing with an article, said device being attachable to said article as a tubular sleeve open at opposite ends thereof and positioned over a writing end of the article while enabling writing with the article, wherein said device comprises vertically oriented collapsible bristles of about 0.1 cm to about 2.0 cm, said bristles creating a cylindrical or barrel shape of different sizes around said article, said bristles controllably collapsing in direct response to an user's grip or grasp of said device without causing discomfort to the hand or fingers of the user when using said device while said device remains attached to said article, said device being of various shapes, sizes, color or design and having advantage of being transferable to another article.

12. The device of claim 11, forming a tubular product that can be temporarily or permanently attached to a writing instrument.

* * * * *